US006665934B2

(12) United States Patent
Lo

(10) Patent No.: US 6,665,934 B2
(45) Date of Patent: Dec. 23, 2003

(54) METHOD FOR MAKING HEAT DISSIPATION DEVICE

(75) Inventor: Wei Ta Lo, Taipei (TW)

(73) Assignee: Foxconn Precision Components Co., Ltd., Taipei Hsien (TW)

( * ) Notice: Subject to any disclaimer, the term of this patent is extended or adjusted under 35 U.S.C. 154(b) by 41 days.

(21) Appl. No.: 10/037,853

(22) Filed: Jan. 7, 2002

(65) Prior Publication Data

US 2002/0095788 A1 Jul. 25, 2002

Related U.S. Application Data

(63) Continuation-in-part of application No. 09/768,405, filed on Jan. 24, 2001, now abandoned.

(51) Int. Cl.[7] ..... B23P 15/00
(52) U.S. Cl. ..... 29/890.03; 29/428
(58) Field of Search ..... 29/890.03, 428; 165/80.3, 185

(56) References Cited

U.S. PATENT DOCUMENTS 5,494,098 A * 2/1996 Morosas ..... 165/121
5,791,406 A * 8/1998 Gonner et al. ..... 165/185
6,125,921 A * 10/2000 Kuo ..... 165/80.3
6,145,586 A * 11/2000 Lo ..... 165/80.3
6,176,304 B1 * 1/2001 Lee ..... 165/185
6,415,852 B1 * 7/2002 Lo ..... 165/80.3
6,435,467 B1 * 8/2002 Lai ..... 248/500
2001/0037571 A1 * 11/2001 Horng ..... 29/890.03
2002/0084060 A1 * 7/2002 Sasaki et al. ..... 165/80.3
2002/0088607 A1 * 7/2002 Lo ..... 165/80.3

* cited by examiner

*Primary Examiner*—I Cuda Rosenbaum
(74) *Attorney, Agent, or Firm*—Wei Te Chung

(57) ABSTRACT

A method for making a heat dissipation device (3) includes the steps of: providing a metal plate (2) and a fin member (1), bending the metal plate to form a body (2'), and attaching the fin member to the body. The metal plate includes a central portion (22) and a pair of end portions (24). The central portion is thicker than the end portions. The body includes a chassis (22') originating from the central portion of the metal plate, and a pair of side walls (24') originating from the end portions of the metal plate. The fin member is attached to the chassis between the side walls.

9 Claims, 4 Drawing Sheets

3

METHOD FOR MAKING HEAT DISSIPATION DEVICE

CROSS-REFERENCE TO RELATED APPLICATION

This application is a continuation-in-part (CIP) application of my U.S. patent application Ser. No. 09/768,405, filed on Jan. 24, 2001, now abandoned entitled Heat Dissipation Device and whose disclosure is incorporated by reference herein.

BACKGROUND OF THE INVENTION

1. Field of the Invention

The present invention relates to methods for making heat dissipation devices, and more particularly to a method for making a heat dissipation device which provides great heat removal capability.

2. Related Art

Electronic devices such as central processing units (CPUs) generate a lot of heat during normal operation. This can deteriorate their operational stability and damage associated electronic devices. Thus the heat must be removed quickly to ensure normal operation. A heat dissipation device is often attached to a top surface of a CPU, to remove heat therefrom.

A conventional heat dissipation device is formed by extrusion, which significantly limits the height of its formed fins. Furthermore, to meet increasing demands for dissipation of ever-increasing amounts of heat, larger and larger heat dissipation devices are being manufactured. This results in excessively heavy heat dissipation devices, and high costs for manufacturers.

To resolve the above-mentioned problems, another kind of heat dissipation device has been developed. The fins of such device are folded from a metal sheet. A chassis in thermal contact with a CPU supports the fins. The device has a large heat dissipation surface area. However, because the fins are folded from a metal sheet, a cooling fan cannot be easily and securely attached to the fins. The device generally removes heat without the benefit of a fan. Furthermore, the chassis of the heat dissipation device is generally a thin metal plate. This limits heat conduction, thereby reducing the efficiency of heat transfer. Oftentimes, the device cannot satisfactorily remove heat from the CPU.

In other conventional heat dissipation devices, a metal block is attached to a bottom of a chassis of the device. This increases a thickness of the chassis engaging with the heat-generating electronic device, and thereby attains higher heat conduction. However, the extra materials required increase manufacturing costs. Furthermore, gaps exist between the metal block and the chassis, thereby retarding heat transfer. Oftentimes, such device cannot attain the required level of heat conduction.

A method for making an improved heat dissipation device which overcomes the above-mentioned problems is strongly desired.

SUMMARY OF THE INVENTION

Accordingly, an object of the present invention is to provide a method for making a heat dissipation device which has great heat removal capability.

Another object of the present invention is to provide a simple, efficient and economical method for making a heat dissipation device.

To achieve the above-mentioned objects, a method for making a heat dissipation device in accordance with the present invention comprises the steps of: providing a metal plate and a fin member, bending the metal plate to form a body, and attaching the fin member to the body. The metal plate comprises a central portion and a pair of end portions. The central portion is thicker than the end portions. The body comprises a chassis originating from the central portion of the metal plate, and a pair of side walls originating from the end portions of the metal plate. The fin member is attached to the chassis between the side walls.

Other objects, advantages and novel features of the present invention will be drawn from the following detailed embodiments of the present invention with attached drawings, in which:

DETAILED DESCRIPTION OF THE EMBODIMENTS

Figure 1:
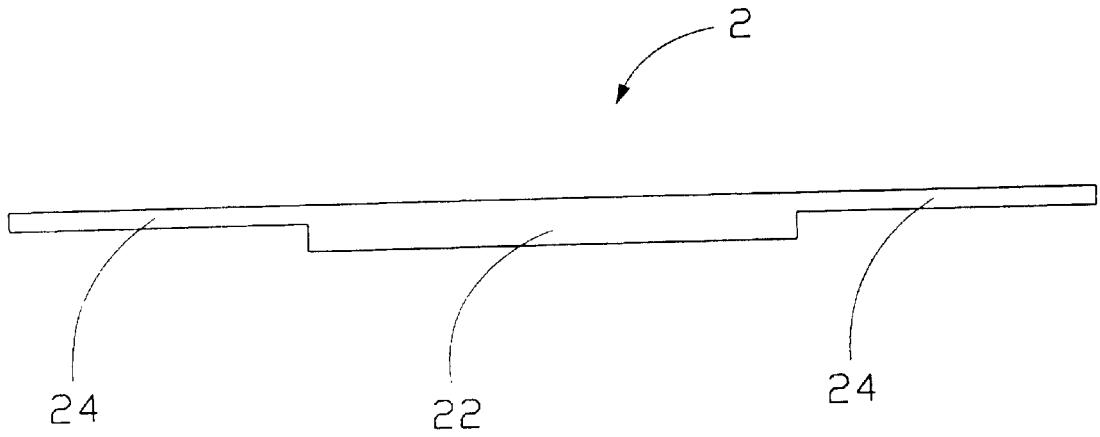
FIG. 1 is a side view of a metal plate for making a body of a heat dissipation device in accordance with a preferred embodiment of the method of the present invention.
Figure 2:
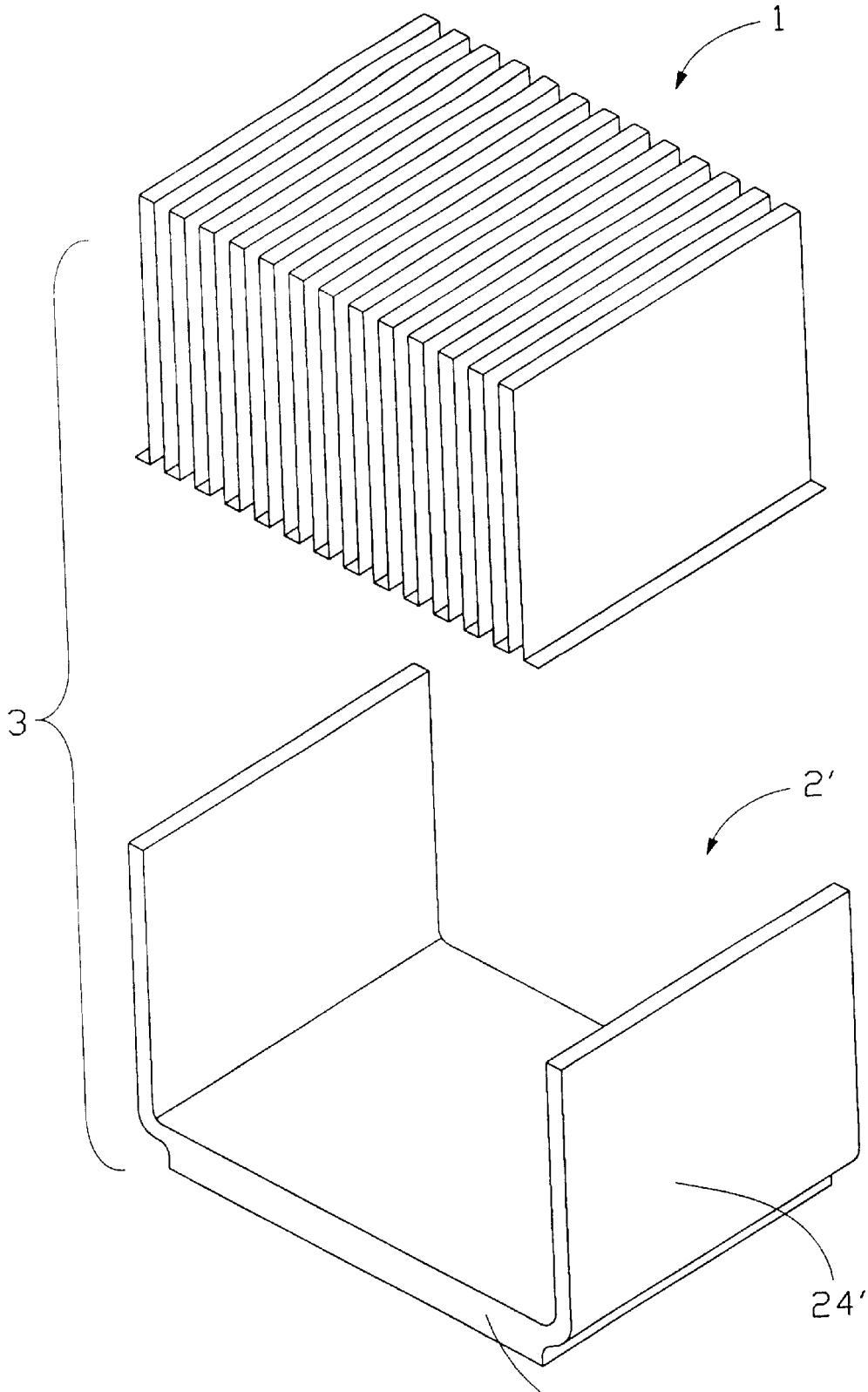
FIG. 2 is an exploded view of a heat dissipation device made in accordance with the preferred embodiment of the method of the present invention.
Figure 3:
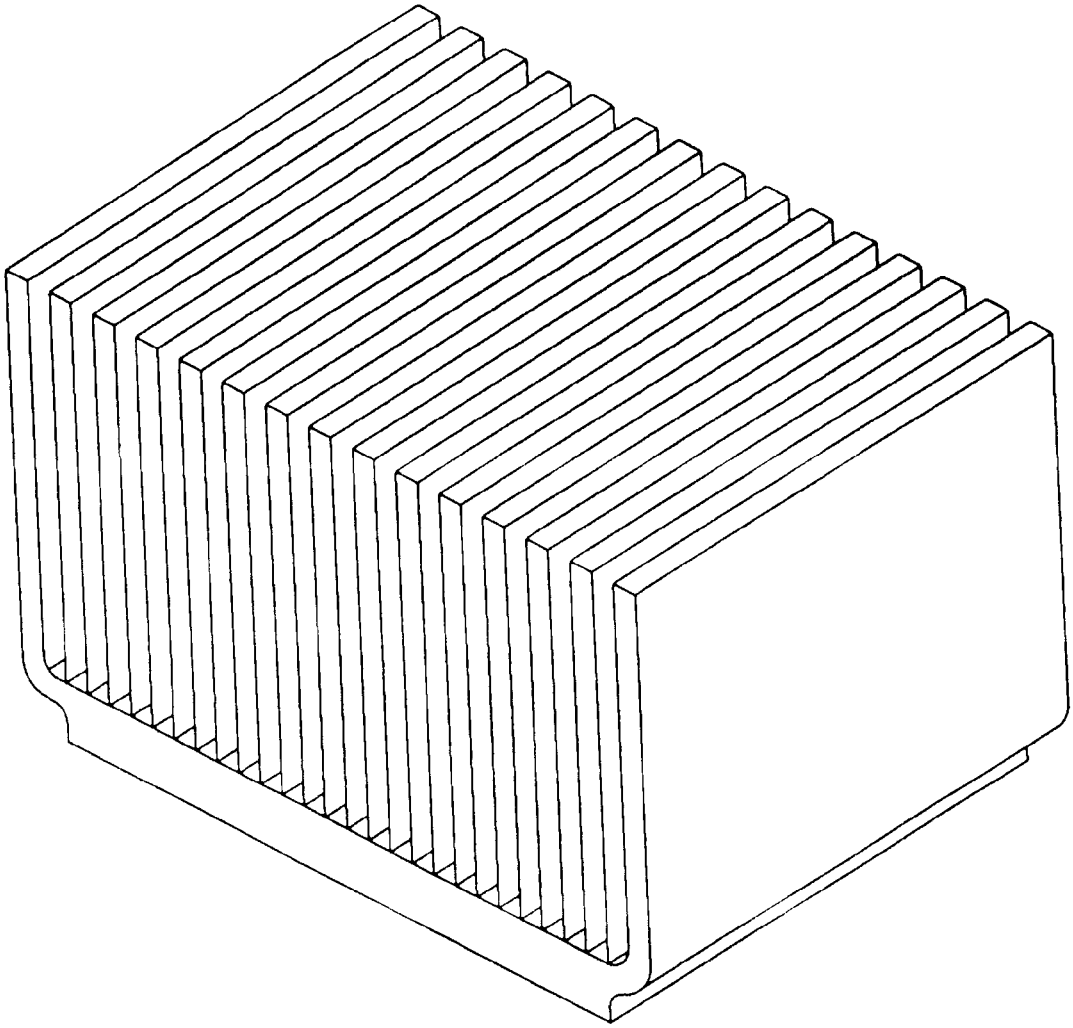
FIG. 3 is an assembled view of FIG. 2.

FIGS. 1–3 show various aspects of making of a heat dissipation device 3 in accordance with a preferred embodiment of the method of the present invention. The heat dissipation device 3 comprises a fin member 1 and a body 2' made from a metal plate 2. The body 2' supports the fin member 1 thereon. The fin member 1 is concertinaed from a single sheet by conventional means, to provide maximum surface area for heat dissipation.

Referring to FIG. 1, the metal plate 2 has a central portion 22 and a pair of end portions 24 extending from opposite sides of the central portion 22 respectively. The central portion 22 and end portions 24 have coplanar top surfaces. Bottom surfaces of the end portions 24 are coplanar. A bottom surface of the central portion 22 is lower than the bottom surfaces of the end portions 24. The central portion 22 is thereby thicker than the end portions 24.

The end portions 24 of the metal plate 2 are bent upwardly from the opposite sides of the central portion 22 respectively, thereby forming the body 2'. The body 2' comprises a chassis 22' originating from the central portion 22 of the metal plate 2, and a pair of parallel side walls 24' originating from the end portions 24 of the metal plate 2. The side walls 24' are perpendicular to the chassis 22', and the body 2' has a substantially U-shaped configuration. The chassis 22' is for thermal contact with a heat-generating electronic device (not shown). The chassis 22' is thicker than either side wall 24', for enhancing heat transfer from the electronic device to the heat dissipation device 3.

Referring to FIG. 3, in assembly, the fin member 1 is attached to a top surface of the chassis 22' between the side walls 24'. The heat dissipation device 3 has a large heat dissipation surface area and a thick chassis 22, for enhancing heat removal.

Figure 4:
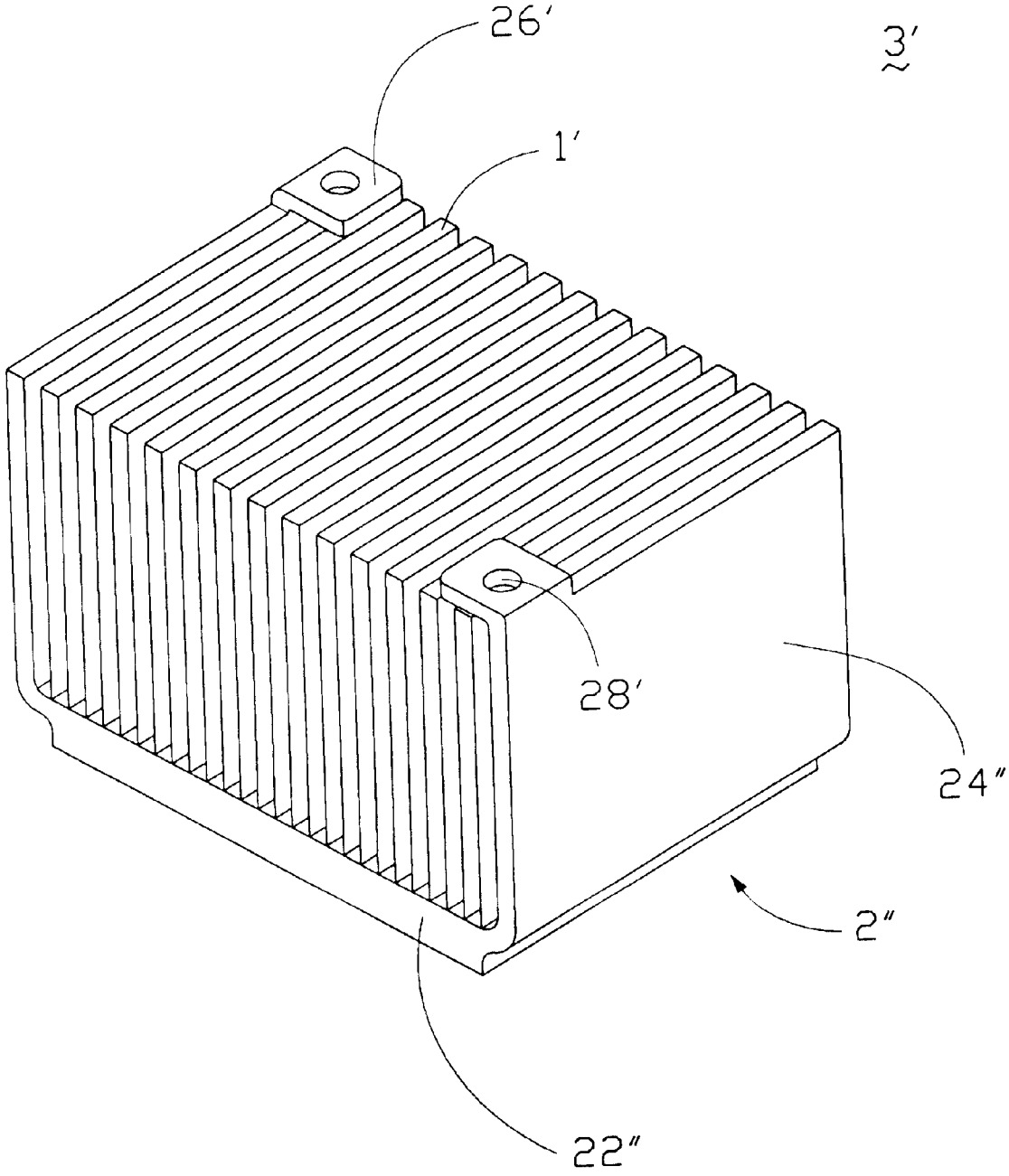
FIG. 4 is an assembled view of another heat dissipation device made in accordance with an alternative embodiment of the method of the present invention.

FIG. 4 shows a heat dissipation device 3' made in accordance with an alternative embodiment of the method of the present invention. The heat dissipation device 3' is similar to the heat dissipation device 3 disclosed in FIGS. 2 and 3. However, a body 2" of the heat dissipation device 3' further comprises a pair of horizontal flanges 26'. The flanges 26' are formed at respective diagonally opposite upper corners of the side walls 24", and extend perpendicularly inwardly from top edges of the side walls 24" respectively. Each flange 26' defines a through hole 28' therein for engagement with a fan (not shown) giving enhanced cooling air flow. When the heat dissipation device 3' is assembled, the flanges 26' are disposed above the fin member 1. For brevity, a detailed description of the heat dissipation device 3' is omitted herefrom. Instead, reference is made to the detailed description of the heat dissipation device 3.

Further alternative embodiments of the present invention include replacing the fin member 1 with a plurality of parallel metal plates. Such plates perform the same function as the fin member 1.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A method for making a heat dissipation device, the method comprising the steps of:

(a) providing a metal plate having a central portion and a pair of end portions at opposite sides of the central portion, the central portion being thicker than the end portions;

(b) bending the end portions of the metal plate to be substantially perpendicular to the central portion to thereby form a substantially U-shaped body, the body comprising a chassis, and a pair of side walls extending from the chassis, the chassis being formed by the central portion of the metal plate, the side walls being formed by the end portions of the metal plate;

(c) providing a fin member; and (d) attaching the fin member to the chassis between the side walls of the body.

2. The method as recited in claim 1, wherein the central and end portions of the metal plate of step (a) have coplanar top surfaces.

3. The method as recited in claim 1, wherein the end portions are bent vertically from the opposite sides of the central portion.

4. The method as recited in claim 1, wherein the fin member is concertinaed from a single sheet.

5. The method as recited in claim 1, wherein the fin member comprises a plurality of parallel metal plates.

6. The method as recited in claim 1, wherein at least one flange extends from at least one of the side walls, and the at least one flange defines a through hole.

7. The method as recited in claim 6, wherein the at least one flange extends perpendicularly from an upper corner of the at least one of the side walls.

8. A method of making a heat dissipation device comprising steps of:

providing a unitary metal plate with a central section and two opposite end sections, top faces of said central section and said two end sections being coplanar;

upwardly bending said two opposite end sections to be in a perpendicular manner relative to said central section; and locating a series of folded fins on said central section and between said two end sections; wherein said folded fins define channels along a direction, and each of said end sections is not interrupted along said direction.

9. The method as recited in claim 8, wherein a height of the folded fins is similar to that of each of said bent end sections.

* * * * *